US007135822B2

(12) United States Patent
Behr et al.

(10) Patent No.: US 7,135,822 B2
(45) Date of Patent: Nov. 14, 2006

(54) TRANSFORMER, LAMP BASE HAVING A TRANSFORMER AND HIGH-PRESSURE DISCHARGE LAMP

(75) Inventors: Gerhard Behr, Altheim (DE); Matthias Burkhardt, Hohenbrunn (DE); Arnulf Rupp, Taufkirchen (DE)

(73) Assignee: Patent-Treuhand-Gesellschaft fur elektrische Glühlampen mbH, Munich (DE)

( * ) Notice: Subject to any disclaimer, the term of this patent is extended or adjusted under 35 U.S.C. 154(b) by 97 days.

(21) Appl. No.: 10/920,420

(22) Filed: Aug. 18, 2004

(65) Prior Publication Data

US 2005/0068143 A1 Mar. 31, 2005

(30) Foreign Application Priority Data

Aug. 26, 2003 (DE) ..... 103 39 587

(51) Int. Cl.
*H01J 7/44* (2006.01)

(52) U.S. Cl. ..... 315/57; 315/70

(58) Field of Classification Search ..... 315/56, 315/57, 70, 76, 77, 82; 336/65, 82, 90
See application file for complete search history.

(56) References Cited

U.S. PATENT DOCUMENTS 3,360,687 A * 12/1967 Riesland ..... 361/674
3,655,906 A * 4/1972 Robb ..... 174/52.2
4,746,840 A * 5/1988 Lim ..... 315/58
4,916,363 A * 4/1990 Burton et al. ..... 315/276
4,939,420 A * 7/1990 Lim ..... 315/58
5,510,967 A 4/1996 Coushaine ..... 362/261
6,084,354 A * 7/2000 Kohmura et al. ..... 315/57
6,124,673 A * 9/2000 Bishop ..... 315/56
6,462,476 B1 * 10/2002 Hirschmann et al. ..... 315/58

FOREIGN PATENT DOCUMENTS

DE 196 52 309 A1 6/1998
EP 1 189 314 A1 5/2001
WO 00/59269 10/2000

* cited by examiner

*Primary Examiner*—Thuy Vinh Tran
(74) *Attorney, Agent, or Firm*—William E. Meyer

(57) ABSTRACT

A transformer for being fitted in a lamp base and to a lamp base having a transformer arranged in it, the transformer housing being provided with guide elements which serve the purpose of inserting the transformer in the correct position in the lamp base. The transformer is preferably in the form of a starting transformer of a pulse starting apparatus integrated in the lamp base of a high-pressure discharge lamp.

3 Claims, 4 Drawing Sheets

TRANSFORMER, LAMP BASE HAVING A TRANSFORMER AND HIGH-PRESSURE DISCHARGE LAMP

I. TECHNICAL FIELD

Figure 1:
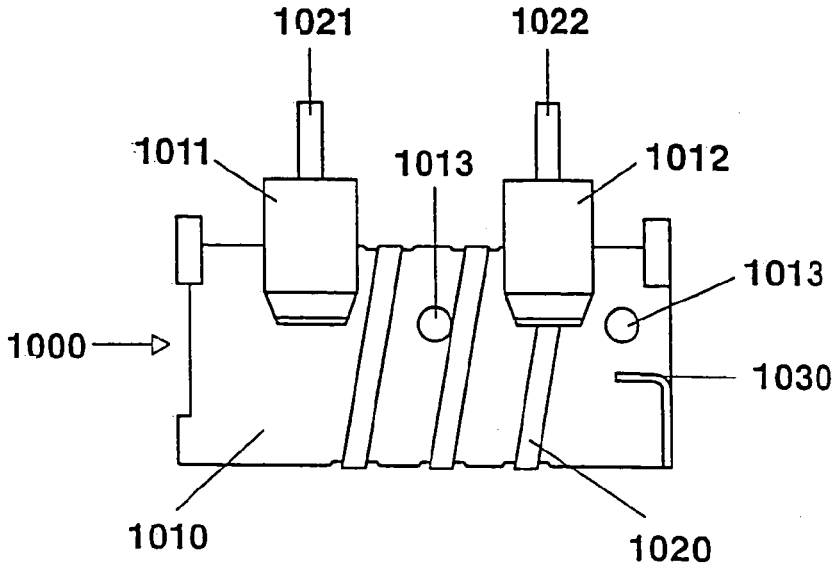

The invention relates to a transformer for being fitted in a lamp base, the transformer having a housing which surrounds at least one winding of the transformer, and to a lamp base having such a transformer as well as to a high-pressure discharge lamp having such a lamp base. The transformer acts, for example, as a starting transformer for generating high-voltage pulses for starting the gas discharge in the discharge medium of a high-pressure discharge lamp.

II. BACKGROUND ART

Such a transformer and such a lamp base are disclosed, for example, in the laid-open specification WO 00/59269. This specification describes a toroidal core transformer, whose windings are surrounded by a housing, and which is arranged in a chamber of the lamp base of a high-pressure discharge lamp.

III. DISCLOSURE OF THE INVENTION

The object of the invention is to provide a transformer which is suitable for being fitted in a lamp base and which can be inserted in the lamp base and contact-connected to said lamp base using automated production machines in an automated production system.

This object is achieved according to the invention by a transformer for being fitted in a lamp base, the transformer having a housing which surrounds at least one winding of the transformer, wherein said housing is provided with guide means which serve the purpose of inserting the transformer in the correct position in a lamp base. Particularly advantageous embodiments of the invention are described in the dependent patent claims.

The transformer according to the invention has a housing which surrounds at least one winding of the transformer, and its housing is equipped with guide means which serve the purpose of inserting the transformer in the correct position in a lamp base. These guide means make it possible to fit and contact-connect the transformer in the lamp base by means of automated production machines in an automated production system. In particular, the guide means ensure that the electrical terminals of the transformer have the correct physical arrangement and alignment with respect to the lamp base.

The guide means advantageously comprise at least one guide web which is integrally formed on the outer side of the transformer housing. This guide web may advantageously be matched to a corresponding groove in the inner wall of the lamp base, with the result that the transformer can be inserted in the correct position in the lamp base using simple means by the at least one guide web and the at least one groove interacting. In order to make it easier to insert the at least one guide web in the corresponding at least one groove, the at least one guide web may have a reduced width on one side, the side which is threaded through or inserted. The abovementioned guide web may also advantageously be used for the purpose of aligning and guiding the electrical terminals of the transformer. For this purpose, the at least one guide web is hollow, and one end of a winding of the transformer is passed through this guide web. This end of the winding forms an electrical terminal of the transformer. The hollow guide web increases the mechanical robustness of said winding end. In addition, an electrical terminal of the transformer is also advantageously used for the correct physical alignment of the transformer by this terminal being in the form of a stiff metal strip or a stiff metal sheet. This electrical terminal formed in this manner forms, together with an electrical contact element arranged in the lamp base, a depth stop for the transformer. The transformer according to the invention is advantageously a rod-core transformer since it has a small physical extent compared to other transformers, such as toroidal core transformers, for example, and is thus better suited for being fitted in narrower conditions in a lamp base. According to the preferred exemplary embodiment of the invention, the ends of the at least one primary winding of the transformer are each passed through a hollow guide web, one end of the at least one primary winding being electrically conductively connected to a first end of the at least one secondary winding of the transformer, and a second end of the at least one secondary winding of the transformer being connected to the electrical terminal, which is in the form of a stiff metal strip or metal sheet, of the transformer. The two abovementioned ends of the primary winding act as electrical terminals for the voltage supply of the transformer. The hollow guide webs serve the purpose of increasing the mechanical robustness of the primary winding ends and of inserting the transformer in the correct position in the lamp base, whereas the electrical terminal of the transformer, which is electrically conductively connected to the abovementioned second end of the at least one secondary winding and is in the form of a stiff metal strip or metal sheet, forms the high-voltage output of the transformer which, together with an electrical contact element arranged in the lamp base, acts as a depth stop for the transformer.

The lamp base according to the invention has a transformer, which is arranged in a chamber of the lamp base, and whose housing surrounds at least one winding of the transformer, the walls of the chamber and the housing of the transformer being provided, according to the invention, with guide means which are matched to one another and which serve the purpose of inserting the transformer in the correct position in the chamber. As has already been mentioned above, the guide means make it possible to fit and contact-connect the transformer in the lamp base by means of automated production machines in an automated production system and, in particular, ensure the correct physical arrangement and alignment of the electrical terminals of the transformer with respect to the lamp base.

The guide means preferably also comprise at least one guide web which is integrally formed on the outer side of the housing of the transformer, as well as at least one groove which is arranged on the inner wall of the chamber and is matched to the at least one guide web. In order to make it easier to fit the transformer in the chamber of the lamp base, the at least one guide web may have a reduced width on one side, the side which is threaded through or inserted, and/or the at least one groove may have a greater width on the insertion side than the guide web width. In addition to the abovementioned guide web, the guide means may also comprise nipples, which are integrally formed on the outer side of the housing and likewise engage in grooves in the inner wall of the lamp base chamber.

The bottom of the chamber of the lamp base, in which the transformer is arranged, preferably has a spacer which, in addition to the electrical contact element on which rests the transformer terminal in the form of a stiff metal strip or metal sheet, forms a second depth stop for fitting the transformer in the chamber.

The lamp base according to the invention is preferably used as a base for a high-pressure discharge lamp, the transformer being in the form of a starting transformer of a pulse starting apparatus integrated in the lamp base.

IV. BRIEF DESCRIPTION OF THE DRAWINGS

Figure 2:
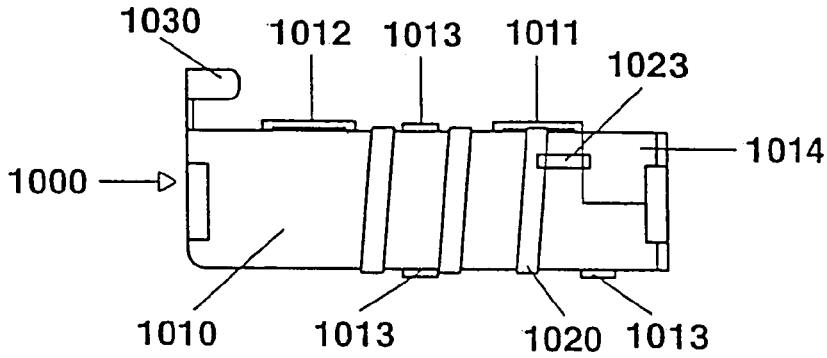
Figure 3:
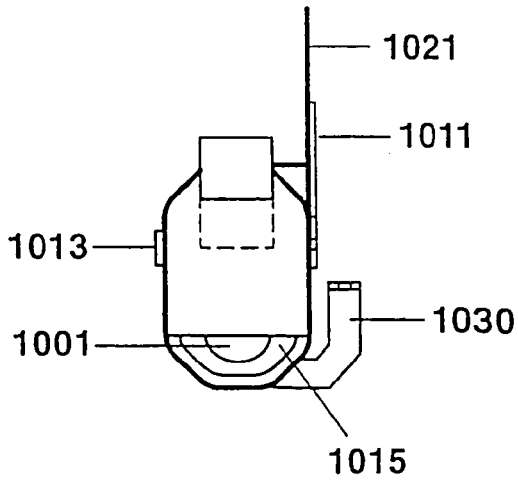
Figure 4:
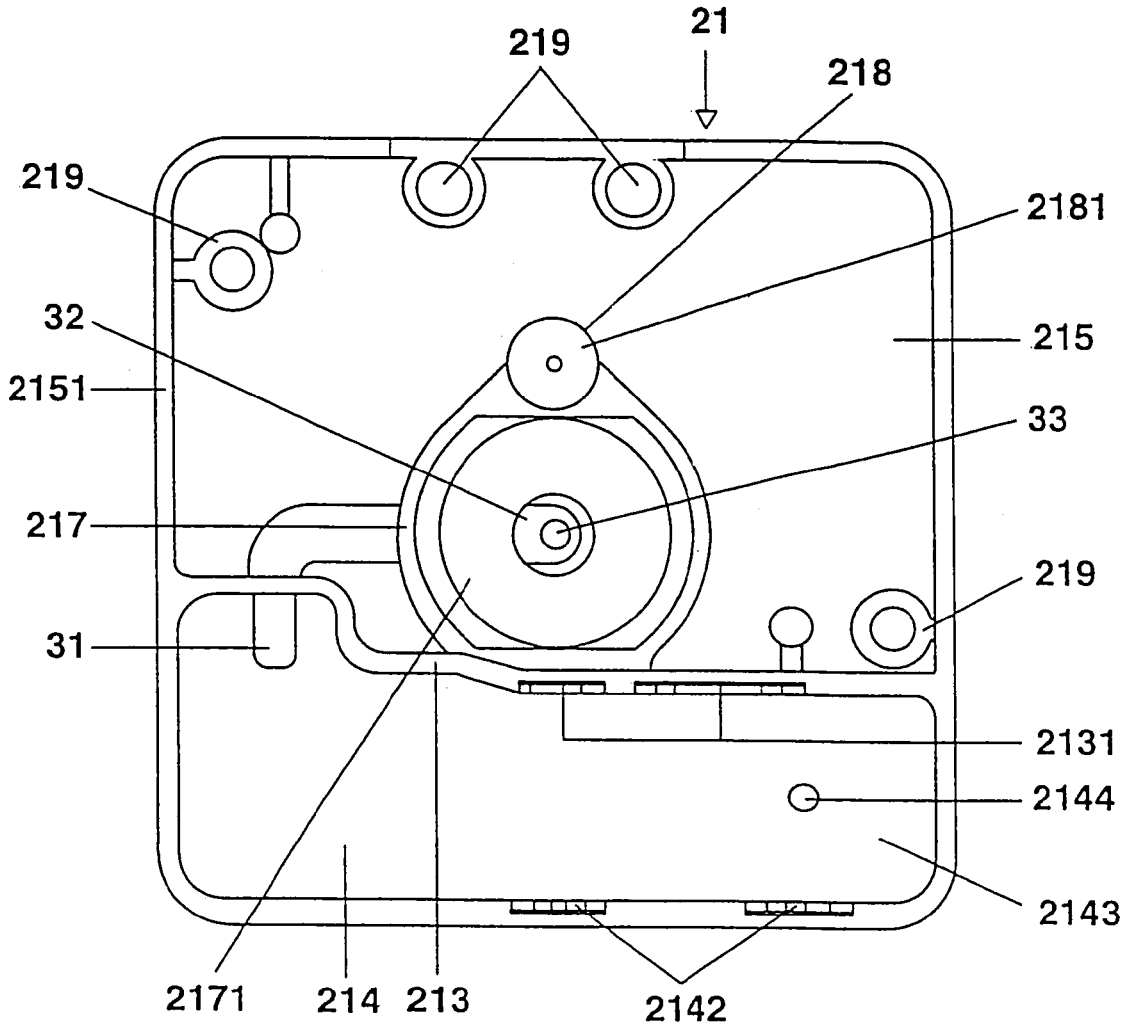
Figure 5:
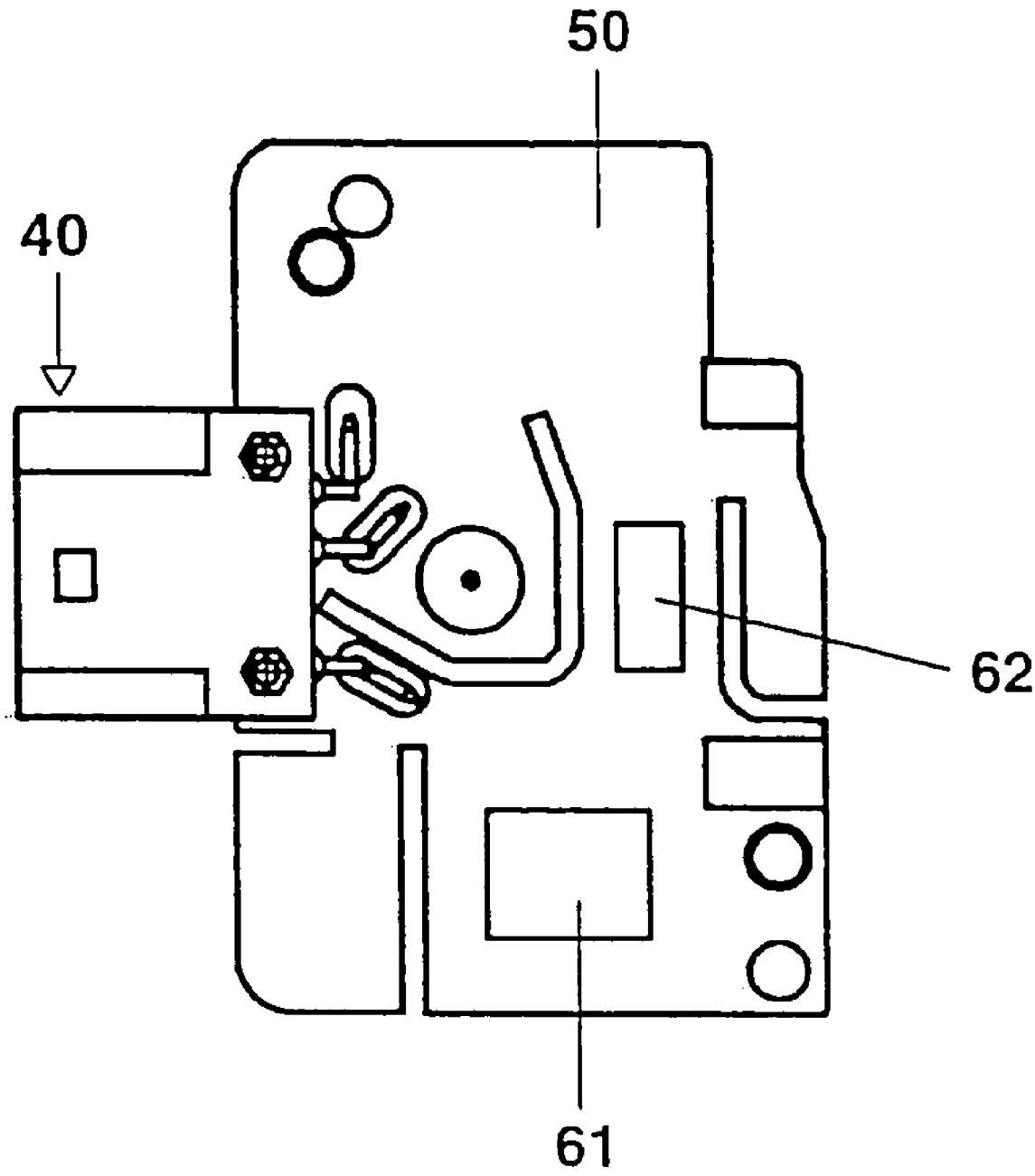
Figure 6:
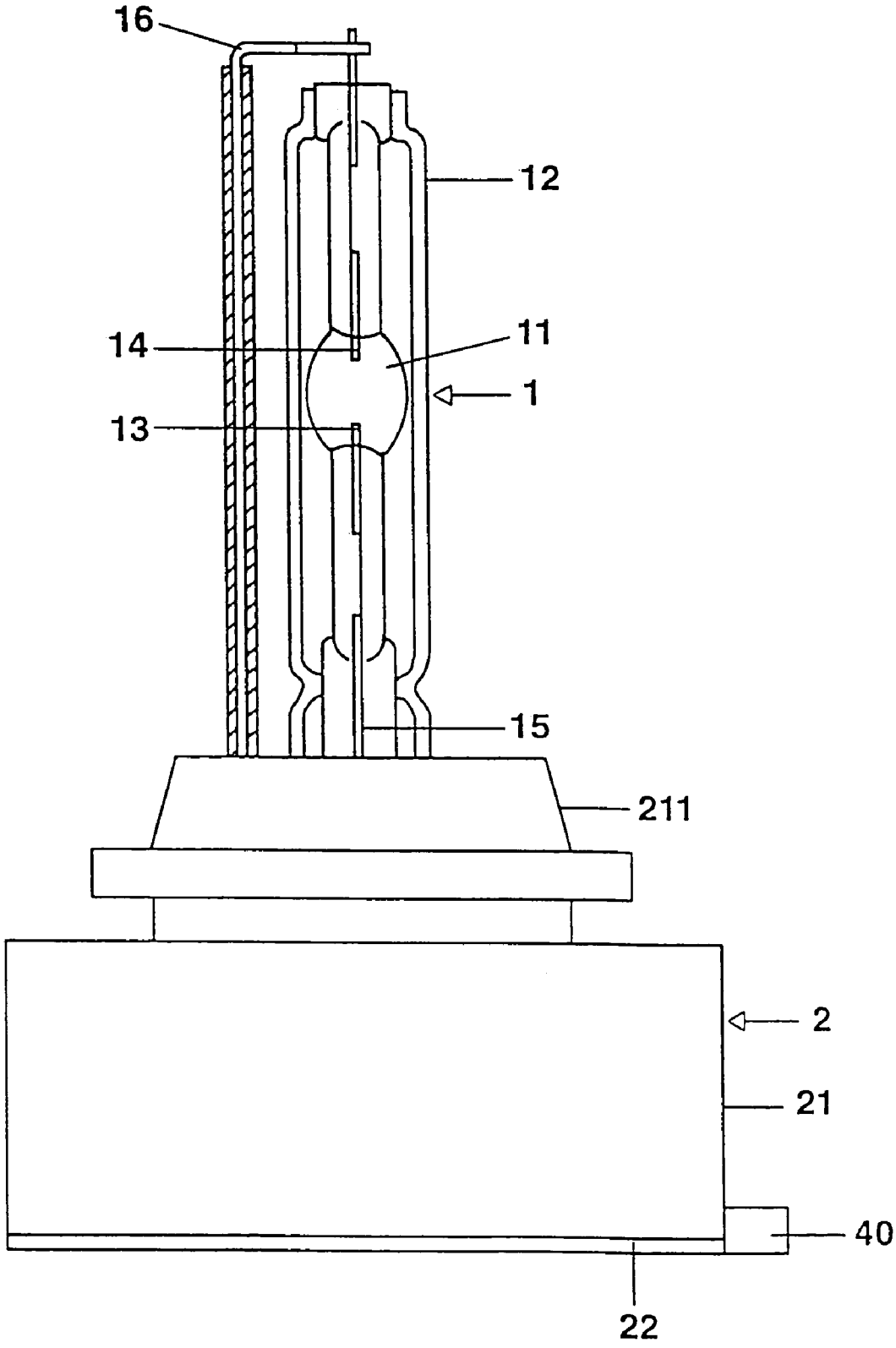

The invention is explained in more detail below with reference to a preferred exemplary embodiment. In the drawings:

FIG. 1 shows a side view of a transformer according to the preferred exemplary embodiment of the invention, FIG. 2 shows a plan view of the transformer depicted in FIG. 1, FIG. 3 shows a plan view of an end side of the transformer depicted in FIG. 1, FIG. 4 shows a plan view of the chamber of a lamp base which is still open and is provided for holding the transformer depicted in FIG. 1, FIG. 5 shows a plan view of the mounting board arranged in the lamp base, and FIG. 6 shows a side view of a high-pressure discharge lamp having the lamp base according to the invention.

V. BEST MODE FOR CARRYING OUT THE INVENTION

The preferred exemplary embodiment (depicted in FIG. 1) of the transformer according to the invention is a rod-core transformer 1000, which forms the starting transformer of a pulse starting apparatus integrated in the lamp base of the high-pressure discharge lamp illustrated in FIG. 6. The rod-core transformer 1000 has a ferrite core 1001 in the form of a rod, on which a secondary winding of the transformer 1000 is wound. The ferrite core 1001 and the secondary winding arranged on it are almost completely surrounded by the plastic housing 1010 of the rod-core transformer 1000. The rod-core transformer 1000 has a primary winding 1020 which is arranged outside the housing 1010 and is wound around the outer side of the housing 1010. The primary winding 1020 comprises a metal strip and has three turns. The ends 1021, 1022 of the primary winding are each passed through a hollow guide web 1011, 1012 which is integrally formed on the outer side of the housing. The ends 1021, 1022 of the primary winding 1020 which protrude from the guide webs 1011, 1012 form the electrical terminals of the rod-core transformer 1000 which serve the purpose of supplying the voltage. The first end 1021 of the primary winding 1020 is electrically conductively connected to the first end 1023 of the secondary winding (not shown) which protrudes from the housing 1010. The first ends 1021, 1023 of the primary winding and the secondary winding are therefore at the same electrical potential, usually at the ground potential, during operation. The guide webs 1011, 1012 and the ends 1021, 1022 of the primary winding 1020 extend transversely with respect to the longitudinal axis of the ferrite core 1001 and of the transformer 1000, respectively. The guide webs 1011, 1012 have on their side which is remote from the ends 1021, 1022 of the primary winding, the side which is threaded through or inserted, a continuously reduced width in order to make it easier to insert these guide webs 1011, 1012 in corresponding grooves 2131 in the lamp base part 21 depicted in FIG. 4. In addition, two or more nipples 1013 are also integrally formed on the outer side of the housing 1010 and likewise engage in grooves 2131, 2142 in the lamp base part 21.

A bent-back, stiff metal sheet 1030 which is electrically conductively connected to the second end of the secondary winding of the rod-core transformer 1000 is arranged on one end side of the rod-core transformer 1000. This metal sheet 1030 forms the high-voltage output of the rod-core transformer 1000. The housing 1010 of the transformer 1000 has two ventilation openings 1014, 1015 which make it possible for the sealing compound to enter the housing 1010 and for the air to be released from the housing 1010 of the transformer when the cavities in the lamp base are filled with sealing compound.

FIG. 4 shows a base outer part 21 in the form of a plastic injection-molded part. This plastic injection-molded part 21 is part of the lamp base 2 of the high-pressure discharge lamp illustrated schematically in FIG. 6 which acts as a light source for a motor vehicle headlamp. This high-pressure discharge lamp has a silica-glass discharge vessel 11, which is surrounded by a vitreous outer bulb 12, having electrodes 13, 14 arranged in it for the purpose of generating a gas discharge. The electrodes 13, 14 are each connected to a power supply line 15 and 16, respectively, which is passed out of the discharge vessel 11, and by means of which they are supplied with electrical power. The module 1 which comprises the discharge vessel 11 and the outer bulb 12 is fixed in the lamp base 2. The lamp base 2 comprises a base outer part 21 and a lid 22, which closes the chambers of the base outer part 21, and a terminal socket 40 for supplying voltage to the high-pressure discharge lamp.

The base outer part 21 has an essentially square cross section. The interior of the base outer part 21 is divided into two chambers 214, 215 of different sizes by means of a partition wall 213. The rod-core transformer 1000 is fitted in the smaller, first chamber 214 and acts as a starting transformer for the pulse starting apparatus, accommodated in the lamp base 2, of the high-pressure discharge lamp. Further components 61, 62 of the pulse starting apparatus are arranged in the larger, second chamber 215. An electrical contact element is embedded in the base outer part 21. Said electrical contact element is made of high-grade steel and forms a module with the base outer part 21. Its ends 31, 32 have flat contact faces.

The first end 31 of the electrical contact element extends into the first chamber 214 and is welded to the high voltage-carrying starting voltage output 1030 of the rod-core transformer 1000 once the rod-core transformer 1000 has been fitted. The second end 32 of the electrical contact element, which is provided with a through-hole 33 for the inner power supply line 15 of the high-pressure discharge lamp, extends into the second chamber 215. A trough 2171, which is delimited by a hollow-cylindrical web 217, is provided in the base outer part 21. The second end 32 of the contact element forms part of the bottom of the trough. Once the inner power supply line 15 has been welded to the second end 32 of the contact element, the trough 2171 is filled with an electrically insulating sealing compound, with the result that the welded joint between the two lamp components 15, 32 is embedded in the sealing compound. The end, which is fed back into the base 2, of the outer power supply line 16, which protrudes from the end of the discharge vessel 11 which is remote from the base, extends into the hollow-cylindrical web 218 which is likewise integrally formed on the base outer part 21. Further hollow-cylindrical webs 219 serve the purpose of fixing the lid 22 and of fixing the terminal socket 40 which forms the electrical terminal of the high-pressure discharge lamp. The end of the web 218 is equipped with a bearing face 2181 for a mounting board 50, whose shape is matched to the cross section of the second chamber 215 such that it fits. The mounting board 50 closes the chamber 215 once it has been fitted. The modules arranged on the mounting board 50, such as the starting capacitor 61 and the spark gap 62 of the pulse starting apparatus, for example, protrude into the second chamber 215. Two or more grooves 2142, 2131 for the guide webs 1011, 1012 and nipples 1013 of the rod-core transformer 1000 are arranged in the side walls 2151, 213 of the first chamber 214. These grooves 2142, 2131 are matched to guide webs 1011, 1012 and to the nipples 1013 on the housing 1010 of the rod-core transformer 1000 such that they fit, with the result that the position of the rod-core transformer 1000 is thereby fixed in the first chamber 214. In addition, a nipple 2144, which, together with the first end 31 of the contact element and the starting voltage output 1030 (resting on said first end 31) of the transformer 1000, determines the insertion depth of the rod-core transformer 1000, is located in the bottom 2143 of the chamber 214. The starting voltage output 1030 of the rod-core transformer is welded to this end 31. The ends 1021, 1022 of the primary winding 1020 are each bent back and are connected to a conductor track on the mounting board 50. The housing 1010 of the rod-core transformer 1000 rests on the nipple 2144 acting as a spacer. The interspace between the rod-core transformer 1000 and the side walls 2151, 213 of the first chamber 214 is filled with an electrically insulating sealing compound. The sealing compound passes through the ventilation openings 1014, 1015 also into the interior of the transformer housing 1010. The lid 22 covers the mounting board 50 and closes the two chambers 214, 215 of the base outer part 21.

What is claimed is:

1. A lamp base comprising a transformer arranged in a chamber of the lamp base, the transformer having a housing which surrounds at least one winding of said transformer, wherein walls of said chamber and the housing of said transformer are provided with guide means which are matched to one another and which serve the purpose of inserting the transformer in a correct position in said chamber, wherein the guide means comprise at least one guide web which is integrally formed on an outer side of the housing of the transformer, as well as at least one groove which is arranged on an inner wall of the chamber and is matched to the guide web, and wherein said at least one guide web is hollow, and one end of a winding of said transformer is passed through this guide web.

2. A lamp base comprising a transformer arranged in a chamber of the lamp base, the transformer having a housing which surrounds at least one winding of said transformer, wherein walls of said chamber and the housing of said transformer are provided with guide means which are matched to one another and which serve the purpose of inserting the transformer in a correct position in said chamber, and wherein two ends of at least one primary winding of said transformer are each passed through a hollow guide web, one end of said at least one primary winding is electrically conductively connected to a first end of at least one secondary winding of the transformer, and a second end of the at least one secondary winding is connected to an electrical terminal, which is in the form of a stiff metal strip or a stiff metal sheet, of the transformer.

3. A lamp base comprising a transformer arranged in a chamber of the lamp base, the transformer having a housing which surrounds at least one winding of said transformer, wherein walls of said chamber and the housing of said transformer are provided with guide means which are matched to one another and which serve the purpose of inserting the transformer in a correct position in said chamber, wherein the guide means comprise at least one guide web which is integrally formed on an outer side of the housing of the transformer, as well as at least one groove which is arranged on an inner wall of the chamber and is matched to the guide web, wherein said at least one guide web is hollow, and one end of a winding of said transformer is passed through this guide web, and wherein two ends of at least one primary winding of said transformer are each passed through a hollow guide web, one end of said at least one primary winding is electrically conductively connected to a first end of at least one secondary winding of the transformer, and a second end of the at least one secondary winding is connected to an electrical terminal, which is in a form of a stiff metal strip or a stiff metal sheet, of the transformer.

* * * * *